US010080420B2

(12) United States Patent
Alexis

(10) Patent No.: US 10,080,420 B2
(45) Date of Patent: Sep. 25, 2018

(54) SYSTEMS AND METHODS FOR A MODULAR STORAGE DEVICE

(71) Applicant: Arthur Anthony Alexis, Austin, TX (US)

(72) Inventor: Arthur Anthony Alexis, Austin, TX (US)

( * ) Notice: Subject to any disclaimer, the term of this patent is extended or adjusted under 35 U.S.C. 154(b) by 218 days.

(21) Appl. No.: 15/266,185

(22) Filed: Sep. 15, 2016

(65) Prior Publication Data

US 2017/0071318 A1 Mar. 16, 2017

Related U.S. Application Data

(60) Provisional application No. 62/219,156, filed on Sep. 16, 2015.

(51) Int. Cl.
*A45F 3/00* (2006.01)
*A45F 3/04* (2006.01)

(52) U.S. Cl.
CPC ..... *A45F 3/04* (2013.01)

(58) Field of Classification Search
CPC ..... A45F 3/04
USPC ..... 224/581
See application file for complete search history.

(56) References Cited

U.S. PATENT DOCUMENTS 4,112,991 A * 9/1978 Barbaresi ..... A45C 3/00 150/104
4,263,951 A * 4/1981 Siegel ..... A45C 3/06 150/106
5,361,955 A 11/1994 Gregory
5,533,558 A 7/1996 Carey
6,179,025 B1 * 1/2001 Sutton ..... A45C 3/08 150/105
6,186,201 B1 * 2/2001 Salz ..... A45C 3/08 150/104
6,210,037 B1 4/2001 Brandon
6,314,579 B1 11/2001 Marcon
6,543,499 B2 * 4/2003 McCreery ..... A45C 3/08 150/104
6,626,342 B1 9/2003 Gleason
6,820,664 B1 * 11/2004 Ritch ..... A45C 3/08 150/103
7,028,730 B2 * 4/2006 Pace ..... A45C 3/08 150/103
7,086,437 B1 * 8/2006 Michael ..... A45C 7/009 150/103
7,222,649 B1 * 5/2007 Fox ..... A45C 3/08 150/104
7,246,643 B2 * 7/2007 Andrews ..... A45C 3/08 150/103
7,461,676 B2 * 12/2008 Huie ..... A45C 3/08 150/105
7,628,187 B2 12/2009 Mittelstaedt
7,673,777 B2 3/2010 Gleason
7,789,114 B2 9/2010 Pace
(Continued)

*Primary Examiner* — Peter Helvey
(74) *Attorney, Agent, or Firm* — Pierson IP, PLLC

(57) ABSTRACT

Embodiments disclosed herein describe systems and methods for a modular backpack. The modular backpack may be comprised of reusable, highly configurable, and durable materials. The modular backpack may include a plurality of replaceable layers, including a skeleton, an inner liner, and an outer skin, wherein the skeleton, inner liner, and outer skin are detachable and replaceable.

11 Claims, 6 Drawing Sheets

(56) References Cited

U.S. PATENT DOCUMENTS

| | | | | |
|---|---|---|---|---|
| 8,156,974 | B2 * | 4/2012 | Pace | A45C 3/08 150/103 |
| 8,211,072 | B2 | 7/2012 | Smith | |
| 8,251,113 | B2 * | 8/2012 | Baxter | A45C 1/024 150/103 |
| 9,480,315 | B2 * | 11/2016 | Goodale | A45C 3/08 |
| 9,622,559 | B2 * | 4/2017 | Pace | A45C 3/001 |
| 2001/0015248 | A1 * | 8/2001 | McCreery | A45C 3/08 150/104 |
| 2004/0090773 | A1 * | 5/2004 | Bryan | A45C 3/08 362/156 |
| 2006/0021684 | A1 * | 2/2006 | DeCoro, III | A45C 3/08 150/105 |
| 2007/0175941 | A1 | 8/2007 | Berry et al. | |
| 2007/0209742 | A1 * | 9/2007 | Morgan | A45C 3/08 150/105 |
| 2008/0185082 | A1 * | 8/2008 | Mejia | A45C 3/08 150/105 |
| 2008/0230158 | A1 * | 9/2008 | Romero | A45C 3/08 150/105 |
| 2009/0065110 | A1 * | 3/2009 | Cassella | A45C 13/02 150/104 |
| 2009/0127299 | A1 | 5/2009 | Jamlang | |
| 2009/0188592 | A1 * | 7/2009 | Connacher | A45C 3/001 150/105 |
| 2009/0205102 | A1 | 8/2009 | Anderson | |
| 2011/0042436 | A1 | 2/2011 | Rich | |
| 2012/0012629 | A1 | 1/2012 | Buffinton | |
| 2013/0071046 | A1 | 3/2013 | Avedissian | |
| 2014/0008164 | A1 | 1/2014 | Lai | |
| 2014/0120310 | A1 | 5/2014 | Baychar | |

* cited by examiner

SYSTEMS AND METHODS FOR A MODULAR STORAGE DEVICE

CROSS-REFERENCE TO RELATED APPLICATIONS

This application claims a benefit of priority under 35 U.S.C. § 119 to Provisional Application No. 62/219,156 filed Sept. 16, 2015, which is fully incorporated herein by reference in its entirety.

BACKGROUND INFORMATION

Field of the Disclosure

Examples of the present disclosure are related to systems and methods for a modular storage device. More particularly, embodiments relate to a modular bag with detachable and replaceable components.

Background

Conventionally, backpacks or other carrying devices are sacks that are carried on a user's back. The sacks may be secured with straps positioned over the user's shoulders. Backpacks are commonly used to carry loads or any sort of equipment or devices because of a user's limited capacity to carry heavy weights for long periods of time.

Conventional backpacks are static devices that will include the same pockets, compartments, sections, etc. for the entire period the backpack is used. Accordingly, inner-liners, outer-skins, the number of compartments, sizes or shapes of the compartments, shoulder straps etc. associated with conventional backpacks cannot be changed over the life of the backpack or for different activities.

Backpacks are typically used and owned by the user until the backpack becomes damaged or soiled. When the backpack becomes damaged or soiled, it may be required for the user to purchase a new backpack.

Accordingly, needs exist for more effective and efficient systems and methods for a modular backpack, wherein the modular backpack includes individually separable and removable skins and liners.

SUMMARY

Embodiments disclosed herein describe systems and methods for a modular storage device. The module storage device may be a backpack, wherein the term backpack may refer to a plurality of different storage devices, such as a briefcase, backpack, luggage, container, box, etc.

The modular backpack may be comprised of reusable, highly configurable, and durable materials. The modular backpack may include a plurality of replaceable layers, including a skeleton, an inner liner, and an outer skin. Each of the elements of the modular backpack including the skeleton, inner liner, and outer skin may be configured to be detachable and replaceable.

In embodiments, the inner liner and outer skin may be coupled on opposite surfaces of the skeleton, and the inner liner and the outer skin may be decoupled from the skeleton to be cleaned and/or replaced by other components. Therefore, if desired, a user may be able to buy additional or different inner liners and/or outer skins, which may include a variety of different textures, themes, colors, designs, etc., for personalization and reuse.

The skeleton may be comprised of a plurality of straps. The straps may include rows and columns of straps, which are configured to intersect with each other. The straps may form a partially transparent mesh or a webbed net. The mesh may be configured to secure objects within the skeleton, while also allowing a user to view and/or touch the items secured within the skeleton.

At intersections of the rows of straps and the columns of straps may be rivets. The rivets may be configured to be mechanical fasteners to provide integrity and structural supports to the skeleton. In embodiments, the rivets may also include buttons, wherein different structures may be coupled to the buttons to dynamically change the number of layers covering the backpack, as well as change the shape and/or size of the modular backpack.

In embodiments, a first coupling mechanism and a second coupling mechanism may be positioned on an inner circumference and outer circumference of the skeleton, respectfully. The first coupling mechanism and the second coupling mechanism may be Velcro, hooks, zippers, buttons, etc. that are configured to secure the inner liner and the outer skin to the skeleton, respectfully.

In embodiments, a third coupling mechanism, such as a zipper, may be positioned on an outer edge of the skeleton, wherein the third coupling mechanism is configured to secure a first side of the skeleton with a second side of the skeleton.

A fourth coupling mechanism, such as a zipper, may be positioned on an outer circumference of the skeleton, wherein the fourth coupling mechanism may be configured to secure the outer skin to the skeleton. Accordingly, the inner liner may be coupled to the skeleton with different coupling mechanisms than the outer skin.

The inner liner may be configured to be removably coupled to the skeleton. Accordingly, the inner liner may be coupled to the skeleton, and then detached and removed from the skeleton. The inner liner may be comprised of a material that is different than the outer skin and/or skeleton. For example, the inner liner may be comprised of a waterproof, anti-bacterial material. In embodiments, the circumference and/or body of the inner linear may include first coupling mechanisms that are configured to interface with the first coupling mechanisms positioned on the skeleton.

The outer skin may be configured to be removably coupled to the skeleton. Accordingly, the outer skin may be coupled to the skeleton, and then detached and removed from the skeleton. The outer skin may be comprised of material that is different than the inner liner and/or skeleton. In embodiments, the circumference and/or body of the outer skin may include second coupling mechanisms that are configured to interface with the second coupling mechanisms positioned on the skeleton. Furthermore, the edges of the outer skin may include a zipper that is configured to interface with the fourth coupling mechanisms.

Further embodiments may include replaceable shoulder straps and sleeves, a replaceable back support, a removable sun shade. The shoulder straps and sleeves may be configured to be integrated into the skeleton.

In embodiments, additional structures may be removably coupled to the skeleton to add more functionality to the user, and/or change the shape or size of the modular backpack. For example, the additional structures may include supports to add a baby carrier to the modular backpack.

In embodiments, the inner liner and/or additional structures may be a purpose built replaceable module design for a specific task or situation. For example, an inner liner for a diaper bag, sports bag, hiking backpack, etc. may have different compartments, partitions, separators, etc. from a regular liner.

In further embodiments, the skeleton may be used as an additional structure with the user of the inner liners, outer skin, shoulder straps, etc. For example, the skeleton may be a hammock and the outer skin may be an external net and/or water repellant to protect from environmental effects, and the shoulder straps may be utilized as ties to secure the skeleton hammock to a support structure. Furthermore, the inner liner may be a sock where hiking components may be secured.

In embodiments, the modular storage device may be used as a travel bag, luggage, cargo back, car storage, etc. For example, the modular storage device may be utilized with plastic molds to increase the aerodynamics of the modular storage device.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
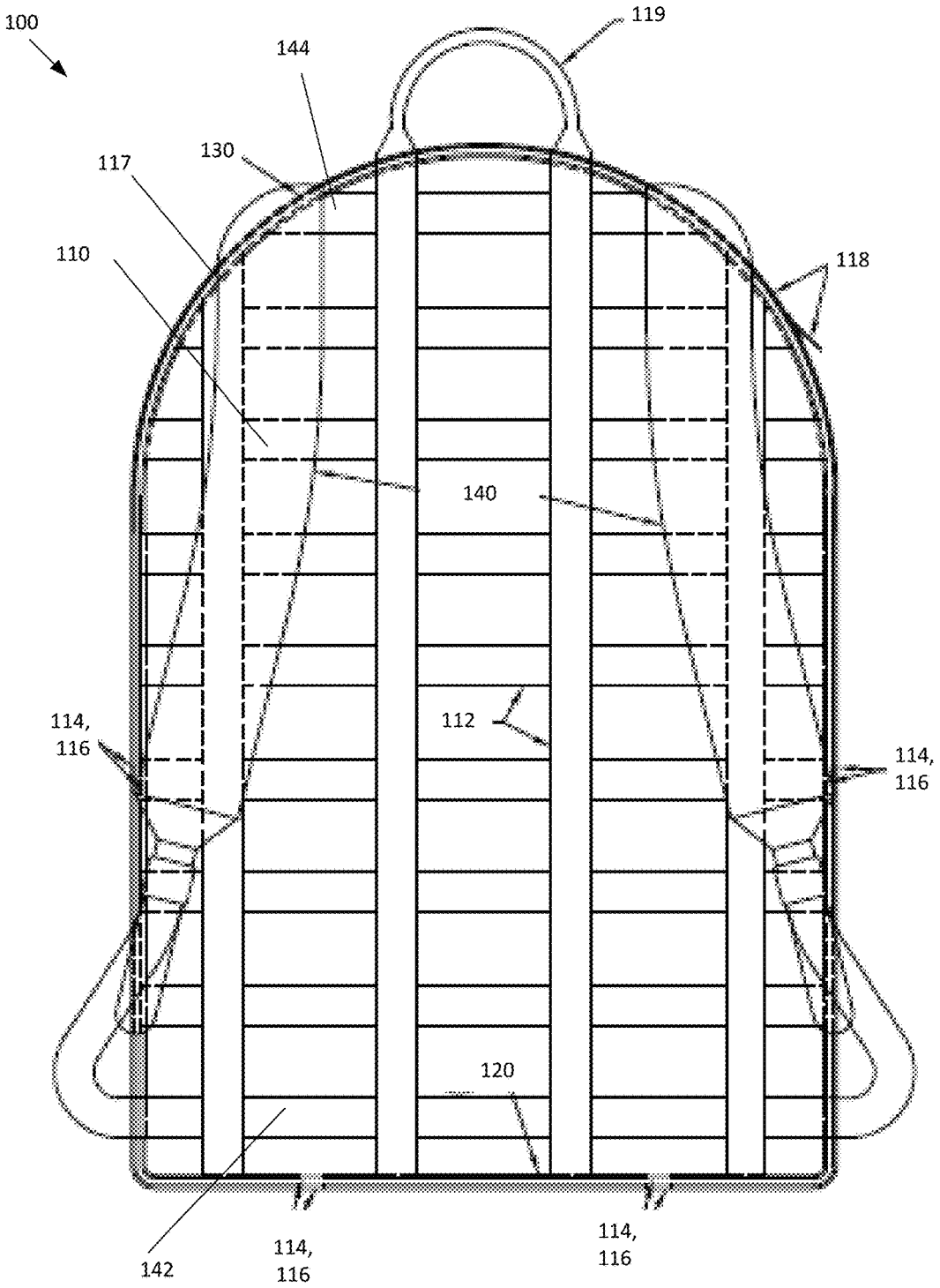
FIG. 1 depicts a modular backpack, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

Embodiments disclosed herein describe systems and methods for a modular storage device, referred to hereinafter as a modular backpack. The modular backpack may be comprised of reusable, highly configurable, and durable materials. The modular backpack may include a plurality of replaceable layers, including a skeleton, an inner liner, and an outer skin, wherein the skeleton, inner liner, and outer skin are detachable and replaceable.

Turning now to FIG. 1, FIG. 1 depicts a modular backpack 100, according to an embodiment. Modular backpack 100 may be comprised of reusable, configurable, and durable materials. Modular backpack 100 may include at least three layers, including skeleton 110, inner liner 120, and outer skin 130.

Skelton 110 may be configured to be a support structure of modular backpack 100, wherein skeleton 110 may be configured to be a foldable, bendable, playable, etc. Skeleton 110 may be configured to be positioned between inner liner 120 and outer skin 130. In embodiments, based on the layout of other elements within modular backpack 100, skeleton 110 may be configured to be an internal or external support structure for modular backpack 100. Skeleton 110 may include two sides that are coupled together via a base that is comprised of a continuous material extending across modular backpack 100. The base may be comprised of a continuous layer extending from a first end of skeleton 110 to a second end of skeleton 110.

In embodiments, skeleton 110 may be comprised of a plurality of straps 112, wherein the plurality of straps 112 include rows of straps and columns of straps that form two sides of skeleton 110. Straps 112 may be comprised of natural polymers, synthetic polymers (such as Nylon), or a combination. The rows of straps 112 and columns of straps 112 may be configured to intersect with each other, wherein rivets may be positioned at each of the intersections of straps. The rivets may be configured to couple the rows of straps 112 with the columns of straps 112, and to provide support for skeleton 110. In embodiments, the rows and columns of straps 112 may form a partially see-through and flexible mesh, wherein the mesh may be folded, bent, stretched, etc, such that the two sides of skeleton 110 may be overlaid on each other. Furthermore, if a user places an object within skeleton 110, the user may be able to view and/or touch the object even if the two sides of skeleton are coupled together.

A circumference of skeleton 110 may include first coupling mechanisms 114 and second coupling mechanisms 116. First coupling mechanisms 114 and second coupling mechanisms 116 may be Velcro, hooks, zippers, buttons, etc. that are configured to secure inner liner 120 and/or outer skin 130 to skeleton 110. In embodiments, first coupling mechanisms 114 and second coupling mechanisms 116 may be configured to extend around the entire circumference of skeleton 110. An outer circumference of skeleton 110 may include a first zipper 117, and an inner circumference of skeleton 110 may include a second zipper 118.

First zipper 117 may extend around an outer circumference of skeleton 110, between the two sides of skeleton, and may be configured to removable couple an outer skin 130 to a first or second side of skeleton 110. In embodiments, each sides of skeleton 110 may include a first zipper 117 that extends around a respective side of skeleton 110.

The second zipper 118 may be configured to allow the first side of skeleton 110 to be removably coupled to the second side of skeleton 110. Second zipper 118 may not extend around the entire circumference of skeleton 110, but may only extend from a first edge of the based to the second edge of the base.

Skeleton 110 may also include handle 119. Handle 119 may be comprised as the same material as the rows and columns of straps 112. Handle 119 may also form two columns of straps 112, wherein a portion of handle 119 extends away the body of skeleton 110. In embodiments, a first end of handle 119 may be coupled to the base of the skeleton 110, extend through and away from the body of skeleton 110 to protrude away from the body of skeleton 110, and a second end of handle 119 may be coupled to the base of the skeleton 110. Accordingly, handle 119 may form two separate columns of straps 112 with ends coupled to the base. By having handle 119 extend through the entire length of a side of skeleton 110, handle 119 may allow skeleton 110 to be sturdier.

Inner liner 120 may be configured to be removably coupled to skeleton 110. Accordingly, inner liner 120 may be coupled to skeleton 110, and then removed from skeleton 110. In embodiments, a first inner liner 120 may be configured to be coupled to a first side of skeleton 110, and a second inner liner 120 may be configured to be coupled to a second side of skeleton 110. Therefore, different sides of skeleton 110 may be covered by inner liners 120 independently. Inner liner 120 may be comprised of a material that is different than outer skin 130 and/or skeleton 110. For example, inner liner 120 may be comprised of a waterproof material. In embodiments, the circumference and/or body of inner linear 120 may include first coupling mechanisms that are configured to interface with the first coupling mechanisms positioned on skeleton 110.

Outer skin 130 may be configured to be removably coupled to skeleton 110. Accordingly, outer skin 130 may be coupled to skeleton 110, and then removed. Outer skin 130 may be comprised of material that is different than inner liner 120 and/or skeleton 110. In embodiments, the circumference and/or body of outer skin 130 may include second coupling mechanisms that are configured to interface with the second coupling mechanisms positioned on skeleton 110. Furthermore, the edges of outer skin 130 may include a zipper that is configured to interface with first zipper 117. Therefore, outer skin 130 may be coupled to skeleton 110 via different coupling mechanisms than those that inner layer 120 is coupled to skeleton 110.

Modular backpack 100 may also include shoulder straps 140. Shoulder straps 140 may be padded surfaces that are integrated within skeleton 110. In embodiments, a lower strap 142 and an upper strap 144 of shoulder straps 140 may extend across a width of a first and/or second side of skeleton 110. Therefore, lower strap 142 and upper strap 144 may form different rows of straps 112 of skeleton 110, which provide more support and structure to skeleton 110.

Figure 2:
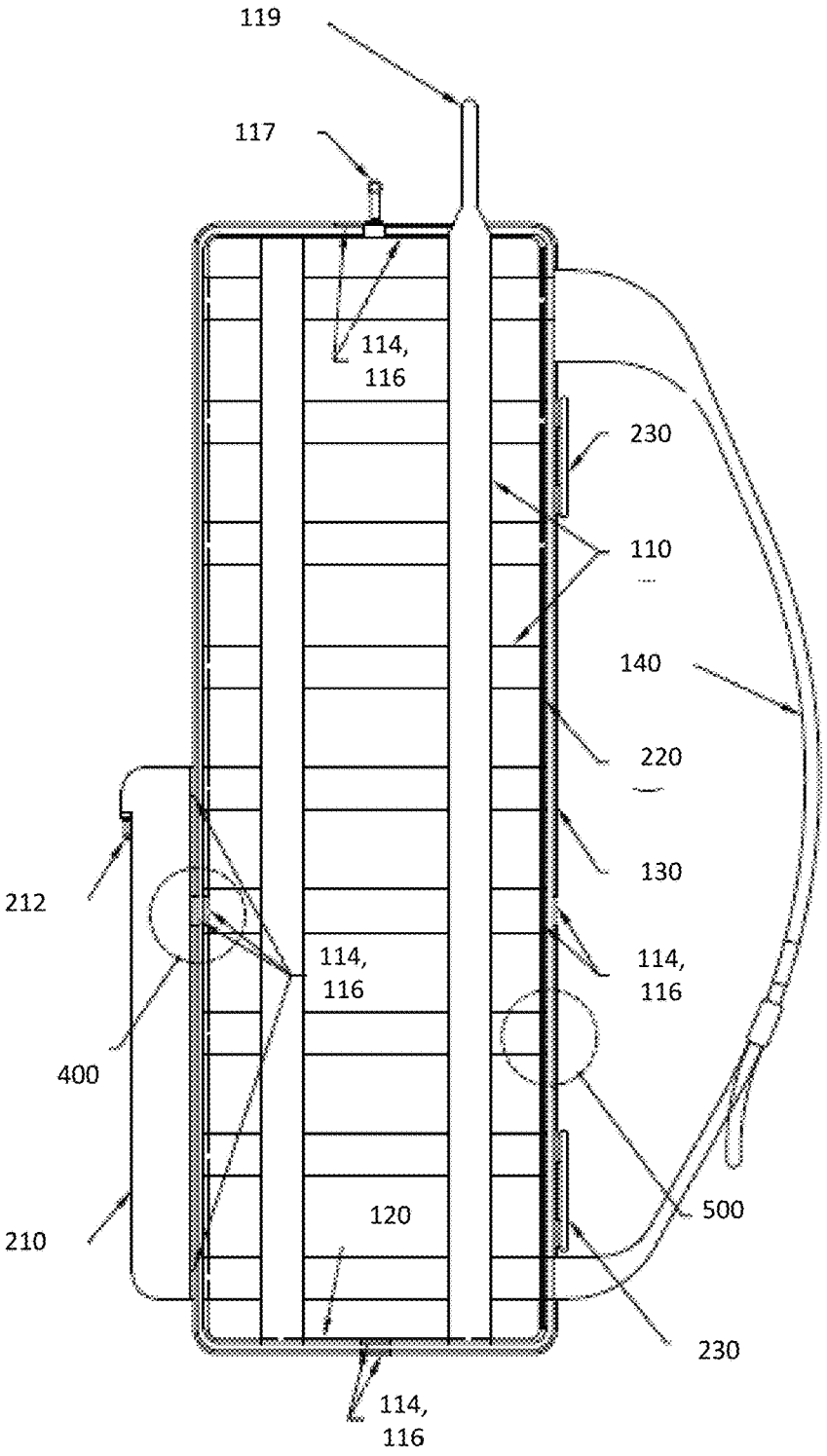
FIG. 2 depicts a side view of a modular backpack, according to an embodiment.

FIG. 2 depicts a side view of modular backpack 100. Elements depicted in FIG. 2 may be described above. For the sake of brevity, another description of these elements is omitted.

As depicted in FIG. 2, handle 119 may have a strap that extends through and is integrated with skeleton 110. Handle 119 may extend positioned more proximate towards a rear end of module backpack 100.

Furthermore, shoulder straps 140 may have straps that are integrated within skeleton 110. These may provide better support, integrity, and durability to skeleton 110.

Additionally, zipper 117 may extend around the entire circumference of skeleton 110, which may enable outer skin 130 to be coupled and decoupled with skeleton 110.

As further depicted in FIG. 2, first coupling mechanism 114 may be positioned on an inner surface of skeleton 110, whereas second coupling mechanism 116 may be positioned on an outer surface of skeleton 110. By positioning the different coupling mechanisms on different surfaces of skeleton 110, different objects, structures, etc. may be coupled to skeleton 110.

Modular backpack 100 may also include an outer pouch 210, an insert 220, and cushion attachments 230.

Outer pouch 210 may be a small bag or any other non-rigid container. Outer pouch 210 may be configured to be coupled with skeleton 110 or outer skin 130. Outer pouch 210 may include a zipper that is configured to open and close to allow a user to access contents stored within outer pouch 210. One skilled in the art will appreciate that outer pouch 210 may be shaped and/or sized as any desired structure of container. For example, outer pouch 210 may be a baby carrier.

Insert 220 may be a removable, rigid, or semi-rigid structure that is configured be coupled with skeleton 110. Insert 220 may be configured to allow a sidewall of skeleton 110 to retain its shape. In embodiments, insert 220 may be a plastic insert that is configured to be coupled on an inner surface of skeleton 110, between skeleton 110 and inner liner 120.

Cushion attachments 230 may be a soft bag stuffed with padding material. Cushion attachments 230 may be positioned on a side of skeleton 110 or on a side of outer skin 130. Cushion attachments 230 may be configured to make modular backpack 100 more ergonomically or comfortable for a user to wear.

Figure 3:
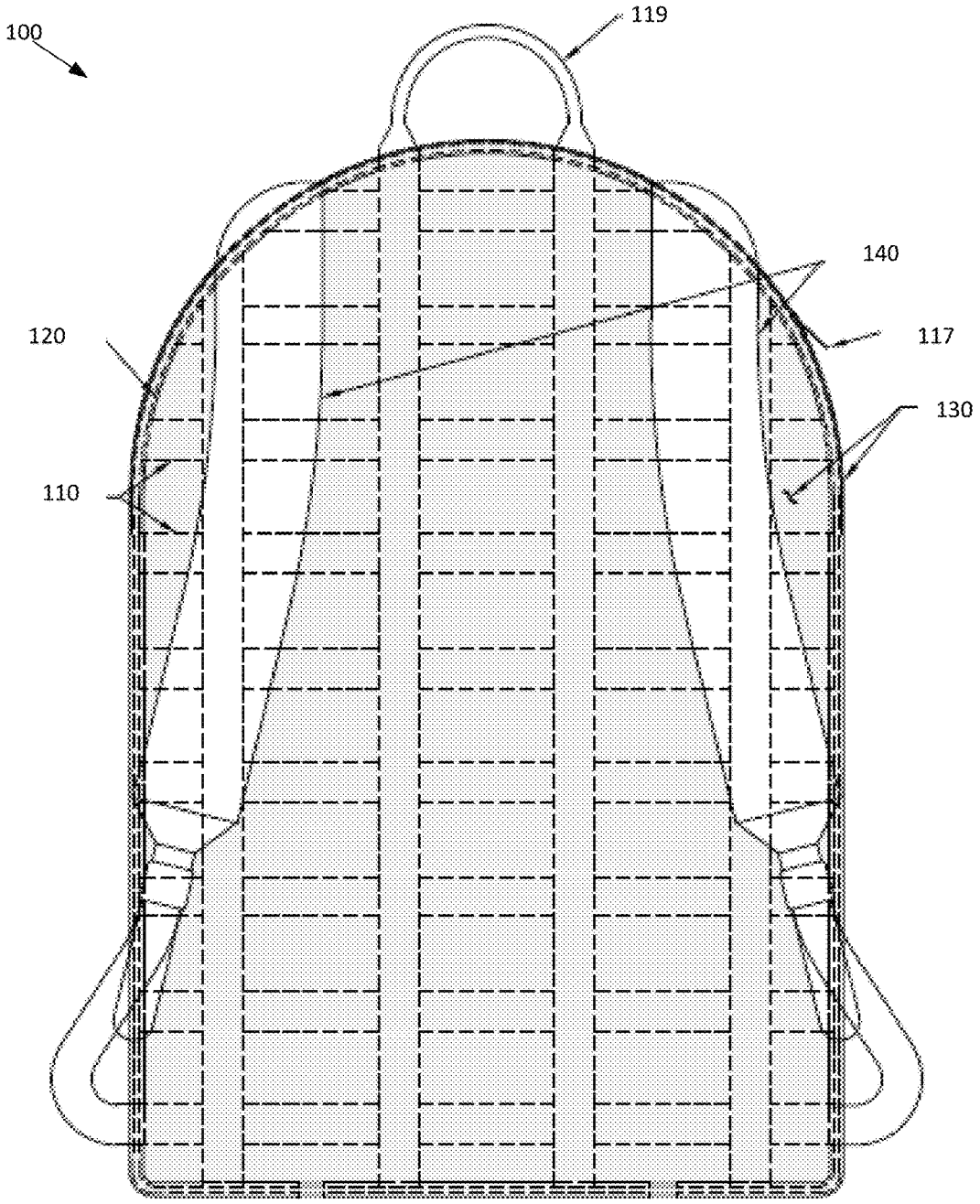
FIG. 3 depicts one embodiment of a modular backpack, wherein an outer skin is coupled to a skeleton, according to an embodiment.

FIG. 3 depicts one embodiment of modular backpack 100, wherein outer skin 130 is coupled to skeleton 110. Elements depicted in FIG. 3 may be described above. For the sake of brevity, another description of these elements is omitted.

As depicted in FIG. 3, when outer skin 130 is coupled to skeleton 110 modular backpack 100 may no longer be transparent. Accordingly, by attaching an outer skin 130 to skeleton 110, outer skin 130 may provide further protection to devices stored within modular backpack 100.

Figure 4:
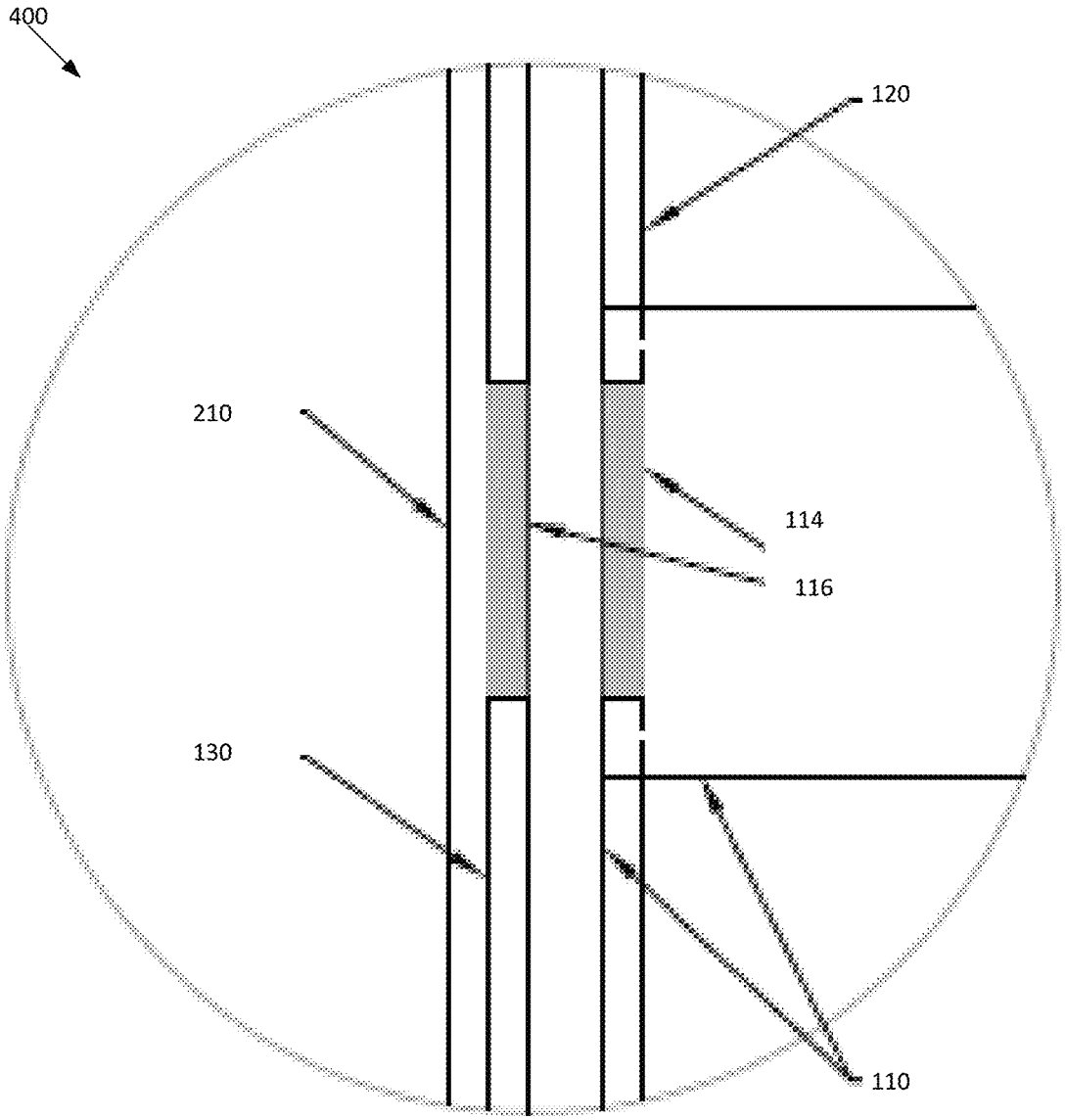
FIG. 4 depicts one embodiment a cross section of a modular backpack, according to an embodiment.

FIG. 4 depicts one embodiment a cross section 400 of modular backpack 100. Elements depicted in FIG. 4 may be described above. For the sake of brevity, another description of these elements is omitted.

As depicted in FIG. 4, skeleton 110 may have a body, wherein inner layer 120 may be configured to be coupled to an inner surface of skeleton 110 via coupling mechanisms 114 and outer layer 130 may be configured to be coupled to an outer surface of skeleton 110 via coupling mechanisms 116. Attachments points of coupling mechanisms 114 and 116 may be symmetrical along the body of skeleton 110.

Furthermore, outer skin 130 may have coupling mechanisms that allow further structures, such as outer pouch 210 to be coupled to an outer surface of outer skin 130.

Figure 5:
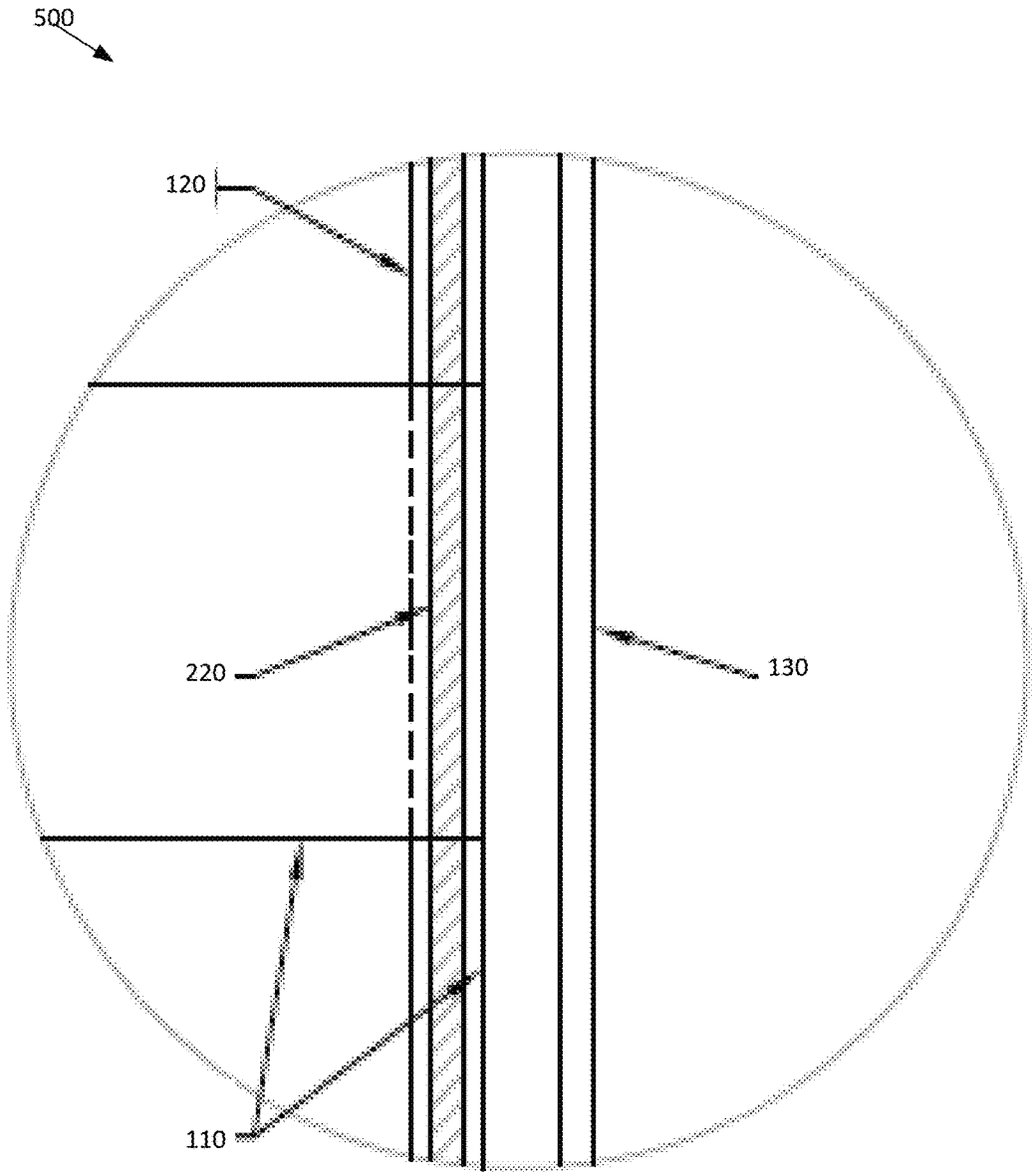
FIG. 5 depicts one embodiment a cross section of a modular backpack, according to an embodiment.

FIG. 5 depicts one embodiment a cross section 500 of modular backpack 100. Elements depicted in FIG. 5 may be described above. For the sake of brevity, another description of these elements is omitted.

As depicted in FIG. 5, insert 220 may be positioned between inner liner 120 and skeleton 110. Furthermore, insert 220 may be inserted into only one side of skeleton 110. Accordingly, insert 220 may be configured to allow a single side of skeleton 110 to be semi-rigid, while the second side of skeleton may remain flexible.

Figure 6:
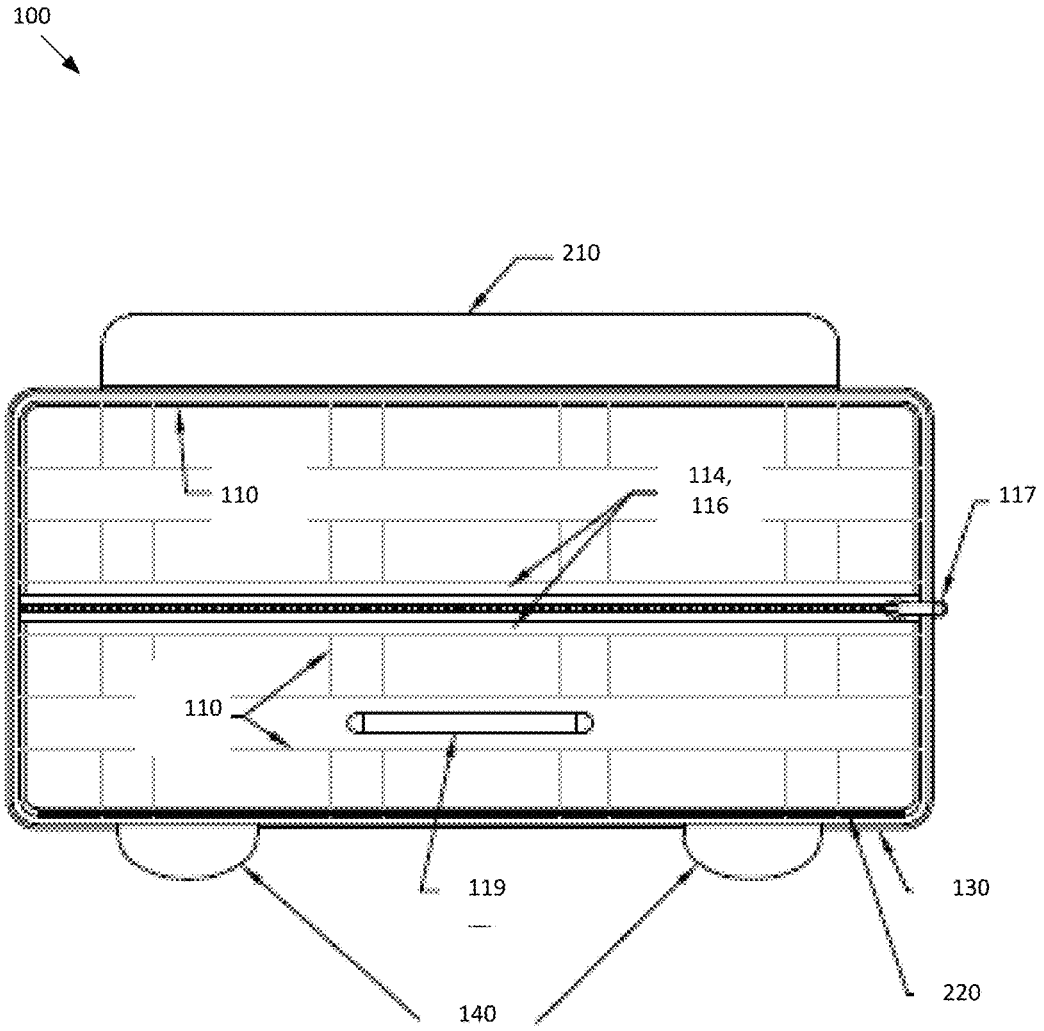
FIG. 6 depicts one embodiment a top view of a modular backpack, according to an embodiment.

FIG. 6 depicts one embodiment a top view of modular backpack 100. Elements depicted in FIG. 6 may be described above. For the sake of brevity, another description of these elements is omitted.

As depicted in FIG. 6, zipper 117 may be configured to extend around a circumference of skeleton 110, wherein outer skins 130 may be coupled to the zipper 117. As further depicted in FIG. 6, zipper 117 may form two separate sides to modular backpack 100, wherein the two separate side of modular backpack 110 may or may not be symmetrical. For example, handle 119 may be positioned on a first side of modular backpack 100, and the second side of modular backpack 100 may not include a handle.

In other embodiments, each piece of the modular bag, such as the skeleton, inner liner, outer skins, outer pouch, and each of the shoulder straps, may be independently removed and coupled to one another.

In other embodiments, the inner liner may have multiple coupling mechanisms, such as Velcro and buttons, wherein the skeleton may have corresponding coupling mechanisms. Accordingly, the inner liner may be able to be secured to the skeleton via multiple coupling mechanisms, which may be different than the coupling mechanisms utilized to secure the outer liner to the skeleton.

Additionally, in other embodiments, coupling mechanisms may be positioned on an outer surface of the skeleton at each intersection of the straps on the skeleton. The coupling mechanisms may be buttons, which may enable the coupling of various pockets, bags, structures, etc. on the outside of the skeleton. Accordingly, the modular bag will be highly configurable.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A modular storage device, comprising:

a skeleton support structure comprised of a foldable material and including a plurality of rows of straps and a plurality of columns of straps that create openings between the plurality of rows and the plurality of columns, the skeleton including a first side and a second side, wherein the first side and the second side are configured to be removably coupled together, the skeleton being comprised of a first material;

a base configured to couple the first side of the skeleton and the second side of the skeleton, the base including a continuous layer extending across a width of the skeleton;

an inner liner configured to be positioned inside of the skeleton via first coupling mechanisms, wherein the inner liner is comprised of a second material;

an outer liner configured to be positioned outside of the skeleton via second coupling mechanisms, wherein the outer liner is comprised of a third material, wherein the first material, the second material, and the third material are different materials;

a handle forming two of the plurality of columns, a first end of handle and a second end of the handle being coupled to the base, and a center portion of the handle forming an arch positioned outside of a body of the skeleton.

2. The modular storage device of claim 1, wherein the inner liner includes a first inner liner and a second inner liner, the first inner liner being configured to be coupled with the first side of the inner liner and the second inner liner being configured to be coupled with the second side of the inner liner, the first inner liner and the second inner liner being comprised of a waterproof material.

3. The modular storage device of claim 2, wherein the first inner and the second inner liner are configured to be removably coupled to the skeleton.

4. The modular storage device of claim 1, wherein the handle is positioned more proximate to the first side of the skeleton than the first side of the skeleton.

5. The modular storage device of claim 4, wherein the handle is positioned around a circumference of the skeleton.

6. The modular storage device of claim 1, further comprising shoulder straps, wherein the a first end of one of the plurality of rows is coupled with a first shoulder strap, and a second end of the one of the plurality of rows is coupled with a second shoulder strap.

7. The modular storage device of claim 1, wherein the one of the plurality of rows extends across a width of the skeleton.

8. The modular storage device of claim 7, wherein the one of the plurality of rows intersects with the plurality of columns forming the handle.

9. The modular storage device of claim 7, wherein the one of the plurality of rows is the bottom most row of the plurality of rows.

10. The modular storage device of claim 1, wherein the two of the plurality of columns forming the handle are centrally positioned.

11. The modular storage device of claim 10, wherein there are columns positioned between the two of the plurality of columns forming the handle and an outer boundaries of the skeleton.

* * * * *